United States Patent [19]

Maruhashi et al.

[11] 4,290,803

[45] Sep. 22, 1981

[54] PROCESS FOR DEPHOSPHORIZATION AND DENITRIFICATION OF CHROMIUM-CONTAINING PIG IRON

[75] Inventors: Shigeaki Maruhashi; Morihiro Hasegawa; Takashi Yamauchi, all of Yamaguchi, Japan

[73] Assignee: Nisshin Steel Company, Ltd., Tokyo, Japan

[21] Appl. No.: 159,097

[22] Filed: Jun. 13, 1980

[30] Foreign Application Priority Data

Jun. 29, 1979 [JP] Japan ..... 54-081285

[51] Int. Cl.[3] ..... C21C 7/02; C22B 9/10

[52] U.S. Cl. ..... 75/52; 75/53; 75/257

[58] Field of Search ..... 75/51–58, 75/257; 148/26

[56] References Cited

U.S. PATENT DOCUMENTS

| | | | |
|---|---|---|---|
| 2,333,741 | 11/1943 | Reeder | 75/130 R |
| 2,504,802 | 4/1950 | Christ | 148/26 |
| 3,172,756 | 3/1965 | Bengtsson | 75/52 |
| 3,179,540 | 4/1965 | Asinovskaja | 148/26 |

*Primary Examiner*—P. D. Rosenberg
*Attorney, Agent, or Firm*—Ladas & Parry

[57] ABSTRACT

A process for dephosphorization-denitrification of Cr-containing pig iron by oxidizing refining is disclosed. Said process comprises maintaining the Si content of the molten iron at not more than 0.2%, contacting it with a slag comprising at least one of fluorides and chlorides of alkaline earth metals, at least one of lithium oxide and carbonate, and at least one of oxides of iron and nickel, while controlling oxidation of Cr.

14 Claims, 5 Drawing Figures

PROCESS FOR DEPHOSPHORIZATION AND DENITRIFICATION OF CHROMIUM-CONTAINING PIG IRON

TECHNICAL FIELD OF THE INVENTION

This invention relates to a process for dephosphorization and denitrification of chromium-containing pig iron (pig iron containing not less than 3% chromium (Cr), hereinafter simply referred to as "the Cr pig iron").

BACKGROUND OF THE INVENTION

It is well known that phosphorus (P) has a deleterious effect in iron and steel, especially in stainless steels it causes and develops hot cracking, stress corrosion cracking, etc. Therefore, it is desirable to reduce phosphorus content as much as possible. Until today, however, it has been considered impossible to dephosphorize molten iron containing not less than 3% of Cr.

In the known techniques, the phosphorus involved in the raw materials remains in the resulting products, the amount of which is about 300 ppm. If production of stainless steels and phosphorus content of which is less than this amount is intended, there is not means other than using carefully selected low phosphorus content materials, which, of course, results in high price of the products.

Rather recently, it has been proposed for the purpose of dephosphorization of molten pig iron to incorporate oxides, carbonates or chlorides of alkali metals in the smelting slag. For instance, in Japanese Laying-Open Patent Publication No. 2322/78, "a dephosphorization agent to be used for dephosphorizing molten pig iron comprising a mixture of lime, iron ore, soda ash and fluorite, characterized in that iron oxide is added in an amount not less than 2.5 times the weight of the oxide or carbonate of an alkali metal, the ingredients are mixed and pulverized and heated at 600° C. or higher so that compounds of iron oxides and alkali metal oxides are formed, and CaO is added in an amount from equal with to 10 times the amount of said compounds" is disclosed. In Japanese Laying-Open Patent Publication No. 26715/78, "an auxiliary refining agent for molten iron containing an alkali metal compound, to which a $SiO_2$-containing material containing not less than 50% $SiO_2$ and/or a $SiO_2$-containing material in which the total content of $SiO_2$, $Na_2O$, MnO and FeO is not less than 60% is added, whereby the amount of $SiO_2$ and the $SiO_2$-containing material is respectively 20% or less and 50% or less" is disclosed. Further in Japanese Laying-Open Patent Publication No. 28511/78, "a dephosphorization, desulfurization or dephosphorization-desulfurization slag comprising 30–70% CaO, 10–40% $Ca_2$ as the principal ingredients, and 1–30% of at least one of $Na_2O$, $B_2O_5$, $Na_2B_4O_7$, $K_2O$, $Li_2O$, NaCl, KCl and LiCl" is disclosed.

Although all these slags or refinining agents may be effective for plain pig iron, they are quite ineffective for dephosphorization of the Cr pig iron. All the descriptions of these three quoted Japanese Laying-Open Patent Publications relate dephosphorization of plain pig iron and there is no reference to dephosphorization of the Cr pig iron.

Difficulty of dephosphorization of the Cr pig iron is considered to be as follows.

The oxidation reaction of P, Cr and iron (Fe) are regarded to be as follows:

$$2P + \frac{5}{2} O_2 = P_2O_5 \qquad 3.73 \times 10^{-9}\text{atm} \qquad (1)$$

$$2Cr + \frac{3}{2} O_2 = Cr_2O_3 \qquad 5.07 \times 10^{-14}\text{ atm} \qquad (2)$$

$$Fe + \tfrac{1}{2} O_2 = FeO \qquad 1.37 \times 10^{-9}\text{ atm} \qquad (3)$$

The numerical value for pressure indicated on the right side of each equation represents the equilibrium oxygen (O) partial pressure under the standard state at 1500° C. for each substance. It will be learned from these data that Cr combines with oxygen far easier than P and Fe. This fact is one of the reasons that the dephosphorization of the molten Cr pig iron is extremely difficult in comparison with that of molten plain pig iron containing no Cr. That is to say, in the prior art processes, the intention to dephosphorize by oxidation resulted in oxidation of Cr only, and oxidation of P did not occur. Even if P is oxidized, Cr is oxidized far more. Also it has been learned that the produced oxide of Cr (referred to as $Cr_2O_3$) impairs dephosphorizing power of the slag. It is understood that the formed $Cr_2O_3$ acts as an acidic oxide and combines with $P_2O_5$-fixing materials and substantially reduces their $P_2O_5$-fixing ability. That is, in the case of the Cr pig iron, the fixation of formed $P_2O_5$ is difficult, that is, the so-called rephosphorization becomes a serious problem.

Therefore, in order to carry out dephosphorization of the Gr pig iron, it is necessary to promote the reaction $$2P + 5FeO \rightarrow P_2O_5 + 5Fe \qquad (4)$$

and at the same time to control as much as possible the reaction $$2Cr + 3FeO \rightarrow Cr_2O_3 + 3Fe \qquad (5)$$

The known measures for oxidizing a molten iron bath as controlling oxidation of Cr therein are to reduce the partial pressure of CO of the atmosphere. Specifically speaking, it is known to reduce the pressure of the surrounding atmosphere or to contact a gaseous mixture of an oxidizing gas such as oxygen (O) and an inert gas such as argon (Ar) or nitrogen (N) with the molten iron bath.

Another means for dephosphorizing while controlling oxidation of Cr is to reduce the oxygen potential of the iron bath. The decrease in the oxygen potential of the iron bath can be achieved by increase in the silicon (Si) content in the bath. But it is not desirable because Si is oxidized to $SiO_2$, which lowers basicity of the slag. In this respect, carbon (C) is oxidized to produce CO which has no influence on the slag property. Therefore increase in the C content of the bath is preferred.

According to the knowledge hitherto, as noted in Japanese Laying-Open Patent Publication No. 28511/78 quoted above, which relates to plain carbon steel, and foreseen from the above equation (1), it is thought that in order to promote oxidation of P, the oxygen potential of the iron bath should be raised. In the case of the Cr pig iron, however, it was quite unknown whether oxidation of P (dephosphorization) will satisfactorily occur or not, if the oxygen potential of the iron bath is lowered in order to control oxidation of Cr.

On the basis of the above-mentioned understanding, we tried dephosphorization of the Cr pig iron using the known dephosphorization slags under the conditions under which oxidation of Cr is controlled. But we could not succeed by merely controlling oxidation of Cr. Repeated varied experiments revealed that among alkali metal compounds, $Li_2O$ and $Li_2CO_3$ are especially effective for the purpose of dephosphorization. (Hereinafter in this specification we mean $Li_2O$ and/or $Li_2CO_3$ by the term "the Li compound".)

We carried out dephosphorization of the Cr pig iron using slags containing alkali metal compounds and analyzed the slag after dephosphorization by means of X-ray diffraction method. And we have found that in the presence of $Cr_2O_3$, affinity of the slag containing the Li compound to $P_2O_5$ is stronger than the slag containing compounds of K and Na.

Further we have learned that we have to improve the slag to which the Li compound is added in order to make the contained Li compound act effectively.

Thus we have devised a proper composition of slag in which the costly Li compound is effectively utilized, and thus succeeded in dephosphorization of the Cr pig iron by oxidizing refining, which can be carried out at temperatures not higher than 1600° C. And also it has been revealed that denitrification can be simultaneously effected by this method.

DISCLOSURE OF THE INVENTION

According to this invention, a novel process for dephosphorization-denitrification of molten pig iron containing not less than 3% or Cr (the Cr pig iron) is provided, said process comprising maintaining the Si concentration of said molten pig iron at 0.2% by weight or less, contacting said pig iron with a slag comprising 30–80% by weight of at least one selected from fluorides and chlorides of alkaline earth metals (the first component), 0.4–30% by weight of at least one selected from lithium oxide and lithium carbonate (the second component), and 5–50% by weight of at least one of iron oxides and nickel oxide (the third component), said slag may contain less than 40% by weight of at least one selected from oxides and carbonates of alkaline earth metals (the fourth component), while controlling oxidation of Cr.

In the process of this invention, the Si concentration in the Cr pig iron must be not more than 0.2%. The reason is that Si is preferentially oxidized and impairs oxidation of P, and the formed $SiO_2$ combines with the fixing agent for P substantially reducing the fixing capability thereof. The Si content should preferably be 0.1% or less and more preferably 0.05% or less. Therefore when the Si content of the pig iron high, it is necessary to desiliconize and skim the slag beforehand.

In the dephosphorization-denitrification slag used in the process of this invention, 30–80% by weight of at least one of fluorides and chlorides of alkaline earth metals ($CaF_2$, $CaCl_2$, $MgF_2$, $MgCl_2$ etc.) is contained (the first component). These are dephosphorization reactants and at the same time are solvent materials, and they are low-melting per se, and easily form fluid slag. Also they dissolve the Li compound and retain it stably, and therefore diminish vaporization loss of the Li compound and thus efficiently promote the reaction. Further they retain good fluidity of the slag even when Cr oxides exist therein to some extent. For these reasons, these compounds constitute main ingredients of the slag as good dephosphorization-denitrification reactants and solvent materials. From them, proper one or ones should be selected by considering physicochemical properties such as melting point, volatility, hygroscopicity as well as cost thereof. Calcium fluoride ($CaF_2$) is preferred from the viewpoint of ease in handling, cost, and dephosphorization effect. This component must be contained in an amount not less than 30%. If less than this, it is insufficient as the dephosphorization reactant, and the fluidity of the slag is lowered in the presence of $Cr_2O_3$, and intermixing of P in the slag runs down and thus dephosphorization is impaired. On the other hand, if the content thereof exceeds 80%, there is no advantage corresponding thereto, and the remaining part must be reserved for the other ingredients. The preferred content of these ingredients is 40–75%, and the more preferred content is 45–65%.

In the dephosphorization-denitrification slag used in the process of this invention, 0.4–30% by weight of at least one of $Li_2O$ and $Li_2CO_3$ (the Li compound) is contained (the second component). The Li compound remarkably increases fluidity of the slag and has strong affinity with $SiO_2$, $Al_2O_3$, $B_2O_3$, $Cr_2O_3$, etc., which have deleterious effect on dephosphorization, and thus diminishes their deleterious effect. For the purpose of dephosphorization and denitrification, it must be contained at least in an amount of 0.4% from the experimental data shown later. If it exceeds 30%, there is no advantage corresponding thereto only incurring economic losses. The preferred content is 0.8–20%, and the more preferred content is 1.6–10%.

In the dephosphorization-denitrification slag used in the process of this invention, at least one of iron oxides and/or nickel oxide (FeO, $Fe_2O3$, NiO, etc.) (the third component) must be contained as the oxygen source for oxidizing P in the iron bath. This is a consequence deduced from the above equation (4). Usually these components are used in the form of iron ore, scale, nickel oxide sinter, etc. One of them or a mixture of two or more of them is used. At least 5% by weight of the total amount of the slag is required. For oxidation of P, 5–50% by weight of these ingredients are added. The preferred content is 10–50%, and the more preferred content is 20–50%. When the C content of the iron bath is high, the concentration of iron oxides and/or nickel oxide tends to gradually decrease. The concentration of this component in the slag should be maintained at 1% or higher all the time. If more than 50% of any of iron oxides and/or nickel oxide is added, it tends to cool the slag making it solidify. Oxygen or other oxidizing gases can be used for this purpose, too.

The dephosphorization-denitrification slag used in the process of this invention may contain less than 40% of at least one of oxides and carbonates of alkaline earth metals (CaO, $CaCO_3$, MgO, $MgCO_3$, etc.) (the fourth component). These are basicity-adjustment agents, and dephosphorization reactants. Although these are high melting materials, they form low melting slags when used in combination with any of fluorides and chlorides of alkaline earth metals, iron oxides and alumina. They are basic materials and do not impair dephosphorization-denitrification capability of the slag. The carbonates such as $CaCO_3$ and $MgCO_3$ are immediately converted to oxides at the refining temperature generating $CO_2$. Calcium oxide (CaO), which is advantageous from the viewpoint of cost and ease in handling, is useful for protection of basic refractory materials, raises basicity of the slag, and counteract the deleterious effect of $SiO_2$, etc. Therefore, the amount of this component to be added depends upon the content of the existing inevitable deleterious ingredients such as $SiO_2$, etc. If the inevitable deleterious ingredients such as $SiO_2$ are contained in a larger amount, this component must be added in a larger amount accordingly. But addition of too large an amount of this component raises the melting temperature of the slag and, in the worst case, solidifies the slag almost prohibiting dephosphorization. When the contamination with the deleterious ingredients such as $SiO_2$ is negligible, addition of this ingredient is not always necessary. When CaO is used for dephosphorization-denitrification of the Cr pig iron, it exhibits complicated behavior. This compound has affinity with iron oxides (to produce calcium ferrite), and raises solubility of iron oxides in the slag. This phenomenon per se is advantageous for oxidation of P. But on the other hand, it increases solubility of deleterious $Cr_2O_3$, too. Therefore, existence of a proper amount of CaO is desirable, but too large an amount of this compound is undesirable. Even when CaO is not added, CaO is formed in an amount necessary for dephosphorization reaction by the reaction:

$$Li_2O + CaF_2 \rightarrow 2LiF + CaO.$$

The amount of addition of oxides and/or carbonates of alkaline earth metals is from 0% to less than 40% by weight of the total amount of the slag, preferably 5–20%, and more preferably 7–15%.

In the slag used in the process of this invention, silica, alumina, boron oxide, chromium oxide, ($SiO_2$, $Al_2O_3$, $B_2O_3$, $Cr_2O_3$), etc., are inevitable deleterious ingredients originating from the used refractory materials and/or the slag already existing prior to addition of the dephosphorization slag. Silica ($SiO_2$) and $B_2O_3$ respectively forms low melting silicate and borate with alkali metal oxides. On the other hand, $SiO_2$, $Al_2O_3$, $B_2O_3$, $Cr_2O_3$, etc. act as acidic oxides and combine with $Li_2O$ and CaO and decrease basicity of the slag, and thus impair the dephosphorization capability of the slag used in the process of this invention. Therefore the contents of these ingredients must be maintained as low as possible.

The amount of the slag used in the process of this invention is not critical, usually it is 10–130 kg/ton-metal, and the content of the Li compound in the slag is 0.5–20 kg/ton-metal.

In the process of this invention, control of oxidation of Cr is effected by adjustment of partial pressure of CO in the atmosphere or adjustment of the C content of the iron bath as mentioned before.

The process of this invention can be carried out at a temperature up to 1600° C.

Now the invention is explained in detail with reference to the attached drawings.

BRIEF DESCRIPTION OF THE ATTACHED DRAWINGS

DETAILED DESCRIPTION OF THE INVENTION

Figure 1:
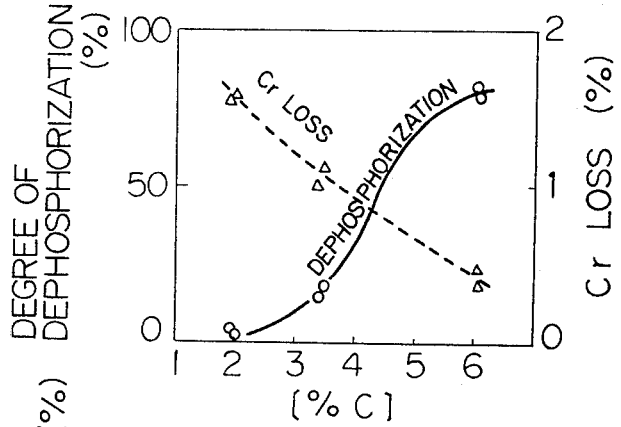
FIG. 1 is a graph showing the relation between C content of the bath and degree of dephosphorization and loss of Cr when dephosphorization of pig iron containing 18% Cr (18-Gr pig iron) is carried out.

FIG. 1 is a graph showing the relation between C content of the molten bath and degree of dephosphorization when 18-Cr pig iron is dephosphorized with a $Li_2CO_3$ 10%—CaO 10%—$CaF_2$ 50%—FeO 30% slag at 1430° C. It is shown that the higher the C content is, the higher the degree of dephosphorization is and the lower the Cr loss is as explained above. However, there is a correlation between C concentration and Cr concentration, of which we will explain in detail later.

Figure 2:
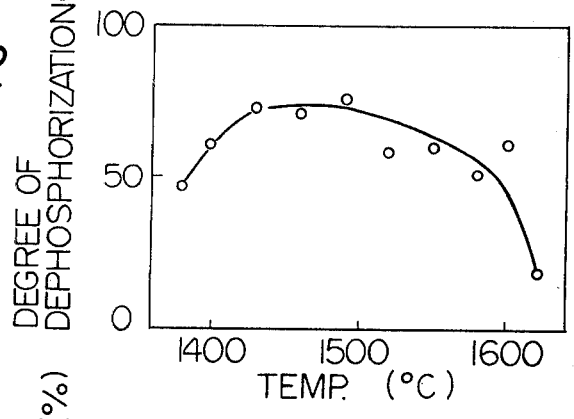
FIG. 2 is a graph showing the relation between temperature of the iron bath and degree of dephosphorization in dephosphorization of 18-Cr pig iron.

FIG. 2 shows influence of bath temperature on degree of dephosphorization when 18-Cr pig iron (C: about 6%) is dephosphorized with a $Li_2CO_3$ 10%—CaO 10%—$CaF_2$ 50%—FeO 30% slag. As seen there, the slag used in this invention is effective even at the temperatures in excess of 1500° C., which is the upper limit of the refining temperature when the known slag containing alkali metal compounds. However, at temperatures in excess of 1600° C., degree of dephosphorization decreases. The reason is that vaporization loss of the Li compound increases at higher temperatures and the dephosphorization products decompose, that is, rephosphorization occurs. On the other hand, at too low temperatures, oxidation of Cr increases and degree of dephosphorization decreases.

Figure 3:
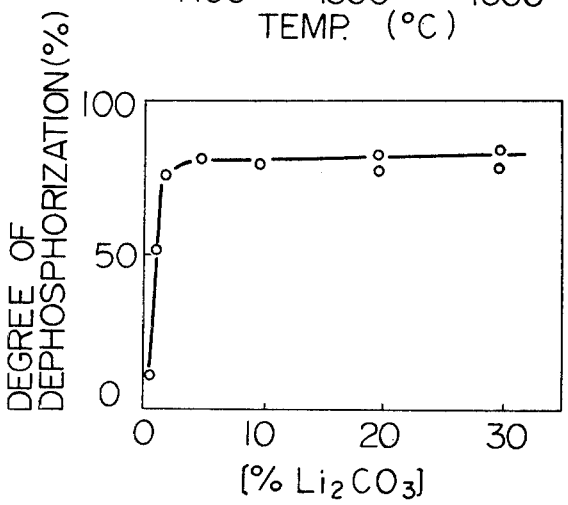
FIG. 3 is a graph showing the relation between $Li_2CO_3$ content in the slag and degree of dephosphorization.

FIG. 3 shows the relation between degree of dephosphorization and concentration of added $Li_2CO_3$ in the slag when 18-Cr pig iron is dephosphorized with a FeO 20%—$CaF_2$ 80% slag containing varied amounts of $Li_2CO_3$ at 1430° C.

If P is removed more than 50%, it is commercially useful. Therefore as seen in FIG. 3, at least 1% $Li_2CO_3$ (0.18% as Li, 0.4% as $Li_2O$) should be contained. If more than 30% $Li_2CO_3$ (5.65% as Li) is used, the degree of dephosphorization is saturated only resulting in increase in vaporization loss of Li. In the process of this invention, the Li compound can be added in the form of the lithium ore. Oxide and/or carbonate of Na and/or K can be added as the auxiliary agent. At any rate, the preferred amount of the Li compound can be learned from this figure.

Concerning the relation between C concentration and temperature of the Cr pig iron, and oxidation of Cr, Hilty's empirical equation is known. This equation is derived simply with respect to the preferential oxidation of C to that of Cr, and as a matter of course, it has nothing to do with the relation of competitive oxidation of P and Cr with respect to the Cr pig iron in contact with a slag containing the alkali metal compound.

Figure 4:
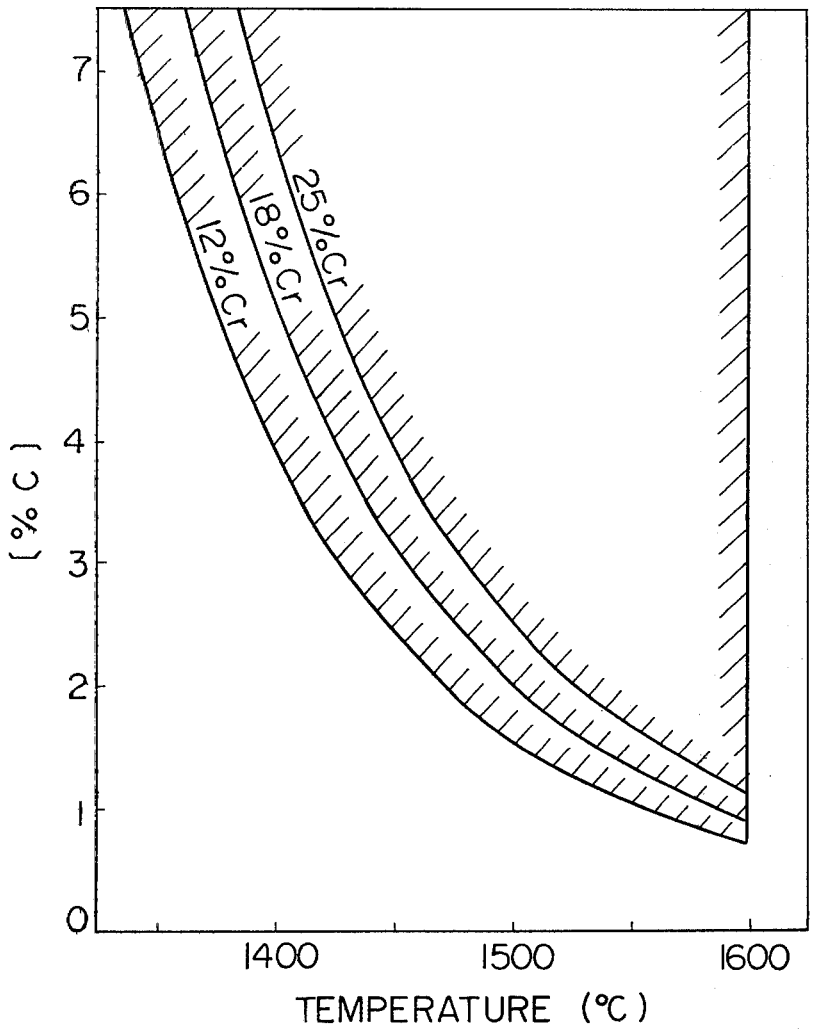
FIG. 4 is a graph showing the relation between C content and temperature whereby dephosphorization is satisfactorily effected.

We studied searching for the conditions under which adequate degree of dephosphorization can be achieved without deteriorating the slag property with respect to the temperature of the iron bath and the C concentration for varied concentrations of Cr. The method we employed was as follows. The Cr pig iron was melted in a magnesia crusible, a graphite ring was floated on the molten bath, and a slag was placed therein. The composition of the slag was $Li_2CO_3$ 10%—CaO 10%—$CaF_2$ 50%—FeO 30%, and it was used in an amount of 70 g/kg-metal. Experiments were carried out with Cr concentration, temperature (t° C.) and C concentration as variables, and the conditions under which commercially significant degree of dephosphorization is obtained are searched for, and such conditions are shown in FIG. 4 as adequate dephosphorization domains. In FIG. 4, the areas provided with hatching are such adequate dephosphorization domains. The relation is represented by the following inequality (6):

$$1600^\circ\ C. \geqq t^\circ\ C. \geqq [-35960/\{\log([\%Cr]^2/[\%C]^3)-21.88\}-273]^\circ\ C. \quad (6)$$

According to the knowledge concerning plain pig iron or plain carbon steel, for dephosphorization, a slag containing alkali metal compounds is used and the oxygen potential of the iron bath is raised. In contrast, in this invention, it has been found that a slag containing the Li compound should be used and the oxygen potential should be lowered by increase in the C content or by some other way. This is contrary to the recognition so far that in the oxidizing dephosphorization, the oxygen potential of the bath should be raised.

The upper limit of the dephosphorization temperature is 1600° C. Because at temperatures over 1600° C. the dephosphorization products are unstable even in the slag used in the process of this invention. However, the slag used in the process of this invention ratains the Li compound stable dissolved therein and thus vaporization loss of the Li compound is diminished, and is characterized in that is possesses dephosphorization-denitrification ability at higher temperatures than the prior art slag containing alkali metal compounds.

As apparent from FIG. 4, there is a lower limit in the iron bath temperature for achieving adequate degree of dephosphorization at a predetermined Cr content and the C content at that time. The reason is that under the lower limit temperature, oxidation of Cr is promoted and $Cr_2O_3$ concentration in the slag is increased. In the dephosphorization of the Cr pig iron, higher C concentration is preferred since wider temperature range is employable at higher C concentration.

This figure presents comprehensively what has been explained above.

Figure 5:
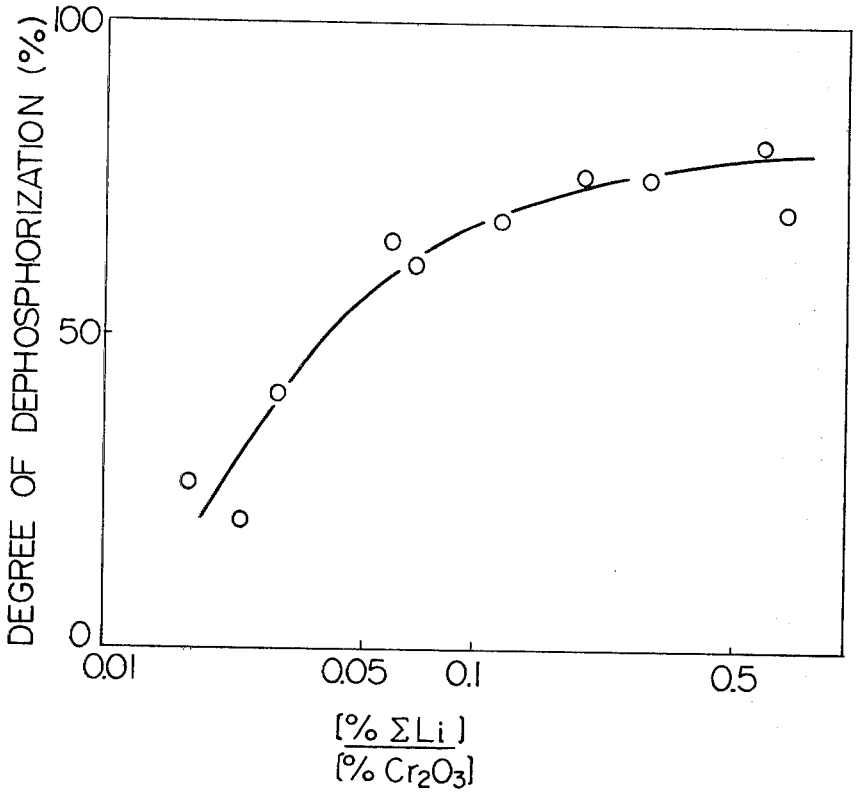
FIG. 5 is a graph showing the relation between degree of dephosphorization and slag composition after the dephosphorization.

FIG. 5 shows the relation between degree of dephosphorization and the composition of the slag after dephosphorization, that is to say, the relation between the degree of dephosphorization defined below and composition of the slag after dephosphorization when 18-Cr pig iron was dephosphorized with a $Li_2CO_3$ 10%—CaO 10%—$CaF_2$ 50%—FeO 30% slag at 1430° C. under varied C concentrations.

$$\text{Degree of dephosphorization} = \frac{[\%P]\text{ before dephosphorization} - [\%P]\text{ after dephosphorization}}{[\%P]\text{ before dephosphorization}} \times 100(\%)$$

The slag composition is represented by $$\frac{[\%\ \Sigma Li]}{[\%\ Cr_2O_3]},$$

whereby [% ΣLi] stands for the total concentration of the Li compounds as Li.

As seen here, when satisfactory degree of dephosphorization is achieved, the value of $$\frac{[\%\ \Sigma Li]}{[\%\ Cr_2O_3]}$$

is 0.05 or more all the time.

In the process of this invention, the slag can be contacted with the iron bath by various ways. The slag is divided into portions and is contacted with the iron bath portion by portion, whereby each portion can be contacted therewith in a different manner. For instance, one portion is introduced into the bath per se and the remaining portion is simply placed on the surface of the bath.

By the process of this invention, not only dephosphorization and denitrification but also desulfurization is effected. The degree of denitrification reaches about 60% or more.

DESCRIPTION OF THE EMBODIMENTS

Now the invention is illustrated by way of working examples.

EXAMPLE 1

One hundred (100) kg of the Cr pig iron containing 6% C, <0.05% Si, and 18% Cr was melted in a graphite crucible by means of a high frequency induction furnace. To the molten bath, 5 kg of a $Li_2CO_3$ 8%—CaO 10%—$CaF_2$ 72%—$Fe_2O_3$ 10% slag was added in three (3) portions at 5-minute intervals. The molten metal and slag were stirred by blowing in argon gas through a porous plug provided at the bottom of the crucible. The treatment was continued for 15 minutes, during which the temperature was maintained at 1420°-1440° C. The compositions of the metal and the slag before and after the treatment are shown in Table 1. The temperature of the iron bath in this example satisfies the condition 1381° C.≦t° C.≦1600° C. which is derived from the inequality (6).

COMPARATIVE EXAMPLE 1

As a comparative example, 100 kg of the Cr pig iron containing 4% C, <0.05% Si and 18% Cr was melted in a magnesia crucible. A graphite ring was floated on the iron bath, into which a slag was introduced. The same amount of the same slag as that used in Example 1 was used. During the treatment, the bath temperature was maintained at 1350°-1380° C. The other conditions were the same as in Example 1. The compositions of the metal and the slag before and after the treatment are shown in Table 1. The degree of dephosphorization is low and the Cr loss is high. The temperature in this comparative example does not satisfy the condition of the inequality (6). Also the C concentration is low.

COMPARATIVE EXAMPLE 2

To the same amount of the same molten metal as in Example 1, 0.4 kg of $Li_2CO_3$ (44%) and 0.5 kg of $Fe_2O_3$ (56%) (0.9 kg in total) were added in three portions. The other experimental conditions were the same as in Example 1. In this comparative example, although $Li_2CO_3$ was used in the same amount as in Example 1, the slag lacks solvent materials and thus the degree of dephosphorization was low.

TABLE 1

| Sample | | Ingredient (%) Metal C | Si | P | Cr | Slag [%ΣLi] | [% $Cr_2O_3$] | [% ΣLi] / [% $Cr_2O_3$] |
|---|---|---|---|---|---|---|---|---|
| Example 1 | Before treatment | 6.21 | <0.05 | 0.025 | 18.09 | | | |
| | After treatment | 6.23 | <0.05 | 0.007 | 17.73 | 1.21 | 7.17 | 0.17 |
| Comparative Ex. 1 | Before treatment | 4.15 | <0.05 | 0.026 | 18.05 | | | |
| | After treatment | 4.10 | <0.05 | 0.022 | 16.94 | 1.04 | 23.10 | 0.045 |
| Comparative Ex. 2 | Before treatment | 6.33 | <0.05 | 0.025 | 18.10 | | | |
| | After treatment | 6.37 | <0.05 | 0.020 | 17.88 | | | |

EXAMPLE 2

One hundred (100) kg of the Cr pig iron containing 6.7% C, <0.05% Si and 25% Cr was melted in a graphite crucible by means of a high frequency induction furnace. To the molten bath, a slag consisting of 1 kg of $Li_2CO_3$, 1 kg of CaO, 3 kg of $CaF_2$ and 1 kg of $Fe_2O_3$ was added in three portions at 5 minutes intervals. The molten metal and the slag were stirred by blowing in argon gas through a porous plug provided at the bottom of the crucible. The treatment was continued for 15 minutes, during which the bath temperature was maintained at 1440°–1460° C. The compositions of the metal and the slag before and after the treatment are shown in Table 2. The temperature of the iron bath in this example satisfies the condition 1396° C.≦t° C.≦1600° C. derived from the inequality (6).

COMPARATIVE EXAMPLE 3

To the same amount of the same molten metal as in Example 2, 2 kg of $Na_2CO_3$, 2.5 kg of CaO, 1.5 kg of $CaF_2$, 1 kg of $Fe_2O_3$ were added respectively in three portions at 5 minute intervals. The other conditions were the same in Example 2. Instead of $Li_2CO_3$, $Na_2CO_3$ was used and the $CaF_2$ content is outside of the range specified in this invention. Therefore, the degree of dephosphorization is low. The compositions of the metal and the slag before and after the treatment are shown in Table 2.

TABLE 2

| Sample | | Ingredient (%) C | Si | P | Cr |
|---|---|---|---|---|---|
| Example 2 | Before treatment | 6.74 | <0.05 | 0.031 | 25.51 |
| | After treatment | 6.80 | <0.05 | 0.010 | 25.04 |
| Comparative Example 3 | Before treatment | 6.64 | <0.05 | 0.030 | 25.47 |
| | After treatment | 6.75 | <0.05 | 0.026 | 25.02 |

EXAMPLE 3

One hundred (100) kg of the Cr pig iron containing 4% C, <0.05% Si, and 12% Cr was melted in a magnesia crucible by means of a high frequency induction furnace. A graphite ring was floated on the metal bath, into which a slag consisting of 0.3 kg (8%) of $Li_2CO_3$, 2.7 kg (73.0%) of $CaF_2$, 0.4 kg (11%) of NiO and 0.3 kg (8%) of CaO was placed. The treatment was continued for 15 minutes, during which 750 l of a gas mixture of 67% $O_2$ and 33% Ar was blown into the bath through an immersed lance. During the treatment, the bath temperature was maintained at 1380°–1400° C. The compositions of the metal and the slag before and after the treatment are shown in Table 3. The partial pressure of CO was lowered by Ar, and therefore the oxidation of Cr was well controlled.

TABLE 3

| Sample | | Ingredient (%) C | Si | P | Cr | Slag Composition after treatment [% ΣLi] | [% $Cr_2O_3$] | [%ΣLi] / [%$Cr_2O_3$] |
|---|---|---|---|---|---|---|---|---|
| Example 3 | Before treatment | 4.01 | <0.05 | 0.023 | 12.20 | | | |
| | After treatment | 3.92 | <0.05 | 0.007 | 12.01 | 1.46 | 6.19 | 0.24 |

COMPARATIVE EXAMPLE 4

The procedure of Example 1 was repeated except that the Si concentration was 0.25%. The results are shown in Table 4. Because of high concentration of Si, the degree of dephosphorization is low.

COMPARATIVE EXAMPLE 5

The procedure of Example 1 was repeated except that 4.5 kg of a $Li_2CO_3$ 9.0%—CaO 16.0%—$CaF_2$ 75% slag was used. The results are shown in Table 4. Since the slag did not contain iron oxide or nickel oxide, the oxidation power is weak and thus the degree of dephosphorization was low.

COMPARATIVE EXAMPLE 6

The procedure of Example 3 was repeated except that 3 kg of a $Li_2CO_3$ 15%—CaO 45%—$CaF_2$ 30%—FeO 20% slag was used, and blowing-in of the Ar—$O_2$ gas mixture was not done. The results are shown in Table 4. Because of high concentration of CaO, the slag was solidified and thus dephosphorization was not satisfactorily effected.

TABLE 4

| Sample | | Ingredient (%) C | Si | F | Cr |
|---|---|---|---|---|---|
| Comparative Example 4 | Before treatment | 6.22 | 0.25 | 0.030 | 18.10 |
| | After treatment | 6.25 | 0.14 | 0.024 | 18.02 |
| Comparative Example 5 | Before treatment | 6.28 | <0.05 | 0.025 | 18.21 |
| | After treatment | 6.30 | <0.05 | 0.019 | 18.11 |
| Comparative Example 6 | Before treatment | 4.04 | <0.05 | 0.024 | 12.27 |
| | After treatment | 4.06 | <0.05 | 0.017 | 12.08 |

EXAMPLE 4

One hundred (100) kg of the Cr pig iron containing 6% C, <0.05% Si and 18% Cr was melted in a magnesia crucible by means of a high frequency induction furnace. A graphite ring was floated on the iron bath, into which 3.5 kg of a slag consisting of 0.5 kg of $Li_2CO_3$, 1 kg of CaO, 3 kg of $CaF_2$, and 3.5 kg of FeO was placed. The treatment was continued for 15 minutes, during which the metal and slag were stirred by blowing-in Ar through a porous plug provided at the bottom of the crucible. The bath temperature was maintained at 1580°-1600° C. The composition of the metal before and after the treatment is shown in Table 5. The amount of the slag remaining after the treatment was about 5 kg.

COMPARATIVE EXAMPLE 7

The procedure of Example 4 was repeated that 0.5 kg of neat $Li_2CO_3$ was used as the slag. The composition of the metal before and after the treatment is shown in Table 5. Most part of the slag was lost by vaporization and only a small amount of solidified slag remained.

TABLE 5

| Sample | | Ingredient (%) C | Si | P | Cr |
|---|---|---|---|---|---|
| | Before | | | | |

TABLE 5-continued

| Sample | | Ingredient (%) C | Si | P | Cr |
|---|---|---|---|---|---|
| Example 4 | treatment | 6.04 | <0.05 | 0.029 | 18.11 |
| | After treatment | 5.97 | <0.05 | 0.014 | 17.98 |
| Comparative Example 7 | Before treatment | 6.07 | <0.05 | 0.028 | 18.13 |
| | After treatment | 5.96 | <0.05 | 0.028 | 18.05 |

EXAMPLE 5

To the same amount of the same molten metal as in Example 1, 5 kg of a $Li_2CO_3$ 10%—CaO 18%—$CaF_2$ 32%—FeO 40% slag was added in three portions as in Example 1. The other experimental conditions were the same as in Example 1. The composition of the metal before and after the treatment was shown in Table 6. Although the $CaF_2$ concentration was rather low, the slag had fluidity sufficient enough for dephosphorization.

COMPARATIVE EXAMPLE 8

The procedure of Example 5 was repeated except that the slag composition was $Li_2CO_3$ 10%—CaO 25%—$CaF_2$ 25%—FeO 40%. The composition of the metal before and after the treatment is shown in Table 6. The $CaF_2$ concentration was too low to act as the dephosphorization reactant, fluidity of the slag is inadequate and thus dephosphorization was not sufficiently effected.

EXAMPLE 6

One hundred (100) kg of the Cr pig iron containing 3% C, <0.05% Si and 18% Cr was melted in a magnesia crucible by means of a high frequency induction furnace. A ring of a refractory material was floated on the molten bath, into which 5 kg of a $Li_2CO_3$ 8%—CaO 10%—$CaF_2$ 52%—$Fe_2O_3$ 30% was added in three portions. The slag and metal were kept under vacuum of 5 Torr. The treatment was continued for 15 minutes, during which the bath temperature was maintained at 1410°-1430° C. The compositions of the metal and the slag before and after the treatment are shown in Table 6. The CO partial pressure was reduced by evacuation, and therefore the oxidation of Cr was well controlled.

TABLE 6

| Sample | | Ingredient (%) Metal C | Si | P | Cr | Slag [% ΣLi] | [% $Cr_2O_3$] | [% ΣLi]/[% $Cr_2O_3$] |
|---|---|---|---|---|---|---|---|---|
| Example 5 | before tr. | 6.15 | <0.05 | 0.023 | 18.29 | | | |
| | After tr. | 6.19 | <0.05 | 0.009 | 18.05 | — | — | — |
| Comparative Example 8 | Before tr. | 6.20 | <0.05 | 0.024 | 18.10 | | | |
| | After tr. | 6.03 | <0.05 | 0.016 | 17.93 | — | — | — |
| Example 6 | Before tr. | 3.16 | <0.05 | 0.026 | 18.22 | | | |
| | After tr. | 2.83 | <0.05 | 0.008 | 18.04 | 1.04 | 3.67 | 0.28 |

EXAMPLE 7

The procedure of Example 1 was repeated under substantially the same conditions except that the bath temperature was maintained at 1500°-1530° C. The N (nitrogen) content of the iron before the treatment with the slag was 0.015% and that after the treatment was 0.002%. The degree of denitrification was 87%.

EXAMPLE 8

The procedures of Example 2 was repeated under substantially the same conditions except that the bath temperture was maintained at 1550°-1600° C. The N content of the iron before the treatment with the slag was 0.020% and that after the treatment was 0.006%. The degree of denitrification was 70%.

EXAMPLE 9

The procedure of Example 3 was repeated under substantially the same conditions except that the bath temperature was maintained at 1490°-1520° C. The N content of the iron before the treatment with the slag was 0.014% and that after the treatment was 0.002%. The degree of denitrification was 86%.

EXAMPLE 10

The procedure of Example 4 was repeated under substantially the same conditions. The N content of the iron before the treatment with the slag was 0.015% and that after the treatment was 0.001%. Thus the degree of denitrification was 93%.

EXAMPLE 11

The procedure of Example 5 was repeated under substantially the same conditions except that the bath temperature was maintained at 1510°-1530° C. The N content of the iron before the treatment with the slag was 0.016% and that after the treatment was 0.002%. Thus the degree of denitrification was 88%.

EXAMPLE 12

The procedure of Example 6 was repeated under substantially the same conditions except that the bath temperature was maintained at 1490°-1540° C. The N content before the treatment with the slag was 0.010% and that after the treatment was 0.003%. Thus the degree of denitrification was 70%.

COMPARATIVE EXAMPLE 9

The procedures of Comparative Example 6 was repeated under substantially the same conditions. The N content of the iron before the treatment was 0.015% and that after the treatment was 0.010%. The degree of denitrification was 33%. The CaO content was so high that the slag was solidified and denitrification was not sufficiently promoted.

INDUSTRIAL USEFULNESS OF THE INVENTION

This invention has made possible the dephosphorization of Cr pig iron by oxidizing refining, which was hitherto regarded to be impossible on a commercial scale. The process of this invention is oxidizing refining, and therefore it is not required to strictly control the atmosphere. Thus no large scale equipment is required. As the vaporization loss of the Li compound is minimized, dephosphorization-denitrification treatment is possible even at temperatures in excess of 1500° C. and use of only a small amount of the expensive Li compound suffices. That is, the cost of the slag is reduced and further generation of fume and dust, which was inevitable disadvantage of alkali metal compounds, is diminished, and the working conditions are remarkably improved.

What we claim is:

1. A process for dephosphorization-denitrification of molten pig iron containing not less than 3% of Cr, comprising maintaining the Si concentration of said molten pig iron at 0.2% by weight or less, contacting said pig iron with a slag comprising 30-80% by weight of at least one selected from fluorides and chlorides of alkaline earth metals, 0.4-30% by weight of at least one selected from lithium oxide and lithium carbonate, and 5-50% by weight of at least one of iron oxides and nickel oxide, said slag may contain less than 40% by weight of at least one selected from oxides and carbonates of alkaline earth metals, while controlling oxidation of Cr.

2. The process as claimed in claim 1, wherein control of oxidation of Cr is effected by reducing the partial pressure of CO of the atmosphere.

3. The process as claimed in claim 2, wherein reduction of the partial pressure of CO is effected by contacting a gaseous mixture of oxygen and inert gas with the molten iron bath.

4. The process as claimed in claim 2, wherein reduction of the partial pressure of CO is effected by evacuation of the atmosphere.

5. The process as claimed in claim 1, wherein control of oxidation of Cr is effected by lowering the oxygen potential of the iron bath.

6. The process as claimed in claim 5, wherein the oxygen potential of the iron bath is lowered by raising the C content of the bath.

7. The process as claimed in claim 6, wherein the C content is maintained at not less than 5%.

8. The process as claimed in claim 7, wherein the C content is maintained at not less than 6%.

9. The process as claimed in claim 6, wherein the relation between C concentration, Cr concentration and temperature of the iron bath is maintained in the relation represented by the following inequality:

$$1600°C. \geqq t°C. \geqq [-35960/\{\log([\%Cr]^2/[\%C]^3)-21.88\}-273]°C.$$

10. The process as claimed in claim 1, wherein the composition of the slag represented by $$\frac{[\% \Sigma Li]}{[\% Cr_2O_3]}$$

after the dephosphorization has been finished is not less than 0.05.

11. The process as claimed in claim 1, wherein the slag contains 40-75% by weight of at least one selected from fluorides and chlorides of alkaline earth metals, 0.8-20% of at least one selected from lithium oxide and lithium carbonate, 10-50% by weight of at least one selected from iron oxides and nickel oxides, and from 0% to less than 40% by weight of at least one selected from oxides and carbonates of alkaline earth metals.

12. The process as claimed in claim 1, wherein the slag contains 45-65% by weight of at least one selected from fluorides and chlorides of alkaline earth metals, 1.6-10% by weight of at least one selected from lithium oxide and lithium carbonate, 20-50% by weight of at least one selected from iron oxides and nickel oxides, and from 0% to less than 40% of at least one selected from oxides and carbonates of alkaline earth metals.

13. The process as claimed in claim 11, wherein the slag contains 5–20% by weight of at least one selected from oxides and carbonates of alkaline earth metals.

14. The process as claimed in claim 12, wherein the slag contains 7–15% by weight of at least one selected from oxides and carbonates of alkaline earth metals.

* * * * *